US009201348B2

(12) United States Patent
Sakurada

(10) Patent No.: US 9,201,348 B2
(45) Date of Patent: Dec. 1, 2015

(54) DEVELOPER DISCHARGE AUXILIARY TOOL AND METHOD FOR DISCHARGING DEVELOPER

(71) Applicant: Konica Minolta, Inc., Tokyo (JP)

(72) Inventor: Takumi Sakurada, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/284,961

(22) Filed: May 22, 2014

(65) Prior Publication Data

US 2014/0356023 A1 Dec. 4, 2014

(30) Foreign Application Priority Data

May 28, 2013 (JP) ..... 2013-111432

(51) Int. Cl.
*G03G 15/08* (2006.01)

(52) U.S. Cl.
CPC ..... *G03G 15/0893* (2013.01)

(58) Field of Classification Search
CPC ..... G03G 2215/00991; G03G 2215/00995; G03G 2215/00978; G03G 15/0893
See application file for complete search history.

(56) References Cited

U.S. PATENT DOCUMENTS 6,305,597 B1 * 10/2001 Donegan et al. ..... 229/117.22
2011/0101000 A1 * 5/2011 Cutler et al. ..... 220/570

FOREIGN PATENT DOCUMENTS

JP 2005193958 A 7/2005
JP 2006224020 A 8/2006
JP 2010-224210 A 10/2010

OTHER PUBLICATIONS

Japanese Notification of Reasons for Refusal corresponding to Application No. 2013-111432; Date of Mailing: May 26, 2015, with English translation.

* cited by examiner

*Primary Examiner* — Clayton E Laballe
*Assistant Examiner* — Ruifeng Pu
(74) *Attorney, Agent, or Firm* — Cantor Colburn LLP

(57) ABSTRACT

A developer discharge auxiliary tool, including a supporting section which supports a developing unit, that is provided with a discharge port to discharge developer contained therein, at a predetermined height with the discharge port down in a state in which the discharge port is located on a lateral or lower side of the developing unit.

3 Claims, 8 Drawing Sheets

DEVELOPER DISCHARGE AUXILIARY TOOL AND METHOD FOR DISCHARGING DEVELOPER

BACKGROUND OF THE INVENTION

1. Field of the Invention

The present invention relates to an auxiliary tool for discharging developer and a method for discharging the developer.

2. Description of Related Art

In electrophotographic image forming apparatuses, toner images are formed by holding toners with developing rollers in developing units which contain developers (developing agents) including toners, making the toners approach electrostatic latent images formed on image holding bodies such as photoreceptors and absorbing the toners to the electrostatic latent images by electrostatic forces.

As described in Japanese Patent Application Laid Open Publication No. 2010-224210, for example, a developing unit is provided with a discharge port for discharging a developer at one end in its longer direction, and thus, the developing unit can be reused by being refilled with a new developer after discharging, through the discharge port, the developer in which the toner was consumed.

SUMMARY OF THE INVENTION

When the developer is discharged from such developing unit, for example, a serviceman removes the developing unit from the image forming apparatus and discharges the developer while supporting the developing unit with his hands so as to direct the discharge port downward above the work table. At that time, the discharge work needs to be performed while maintaining the developing unit at a certain height from the work table so that the discharged developer does not adhere to the developing unit since the developing unit and the image forming apparatus in which the developing unit is set can be damaged if the discharged developer adheres to the developing unit. Since the developing unit has a considerable weight due to its various components such as a stirring screw for stirring and carrying the developer in the developing unit and a developing roller, it is a great burden to discharge the developer while holding the developing unit.

The present invention was made in consideration of the above matters, and an object of the present invention is to provide an auxiliary tool for discharging developer and a method for discharging the developer that can decrease the burden on discharging the developer in the developing unit.

In order to achieve at least one of the above objects, according to one aspect of the present invention, a developer discharge auxiliary tool includes a supporting section which supports a developing unit, that is provided with a discharge port to discharge developer contained therein, at a predetermined height with the discharge port down in a state in which the discharge port is located on a lateral or lower side of the developing unit.

Preferably, in the developer discharge auxiliary tool, a main body which is in a box shape is further included, a cut-out portion through which the developing unit is insertable is formed at a part of the main body, and an edge of the cut-out portion forms the supporting section.

Preferably, in the developer discharge auxiliary tool, the supporting section supports the developing unit by locking a protruding part provided on the developing unit into the edge of the cut-out portion.

Preferably, in the developer discharge auxiliary tool, the cut-out portion is formed by cutting a front surface and a back surface of the main body, and the developing unit is supported by locking two protruding parts provided on the developing unit into respective edges of the cut-out portion in the front surface and the back surface.

Preferably, in the developer discharge auxiliary tool, a width of the cut-out portion is nearly same as a thickness of the developing unit, and the developing unit is sandwiched between lateral edges of the cut-out portion.

Preferably, in the developer discharge auxiliary tool, a bottom surface of the main body includes: a cover which is connected to a front surface or a back surface of the main body; and a tongue which is connected to the cover, a bottom of the main body is configured to be closable by folding the tongue and the cover, inserting the tongue into the main body and covering the bottom of the main body with the cover, and the developer discharge auxiliary tool is configured to be holdable in a state in which a space between a front surface and a back surface is increased by extending the cover and the tongue horizontally and pressing the front surface or the back surface from inside with an end of the tongue.

Preferably, in the developer discharge auxiliary tool, the developer discharge auxiliary tool is configured to be holdable in a state in which a space between a front surface and a back surface is increased by forming a cut piece by making a cut at a part of the front surface or the back surface of the main body, folding the cut piece toward inside of the main body and pressing the back surface or the front surface with an end of the cut piece.

Preferably, in the developer discharge auxiliary tool, the developer discharge auxiliary tool is formed of a flexible material.

Preferably, in the developer discharge auxiliary tool, the developer discharge auxiliary tool is formed of a containing box which contains the developer.

In order to achieve at least one of the above objects, according to the other aspect of the present invention, a developer discharge method for discharging developer from a developing unit used for an image forming apparatus, which contains the developer, forms a toner image on an image holding body and has a discharge port to discharge the developer contained therein on at least one end thereof, the developer discharge method includes discharging the developer through the discharge port by supporting the developing unit, which contains the developer, at a predetermined height with a supporting section formed in a box-shaped main body that is included in a developer discharge auxiliary tool, the supporting section supporting the developing unit with the discharge port down in a state in which the discharge port is located on a lateral or lower side of the developing unit.

Preferably, in the developer discharge method, the developer discharge auxiliary tool is formed so that a cut-out portion through which the developing unit is insertable is formed at apart of a containing box which contains the developer, and an edge of the cut-out portion forms the supporting section.

Preferably, in the developer discharge method, the supporting section supports the developing unit by locking a protruding part provided on the developing unit into the edge of the cut-out portion.

Preferably, in the developer discharge method, the cut-out portion is formed by cutting a front surface and a back surface of the containing box, and the developing unit is supported by locking two protruding parts provided on the developing unit into respective edges of the cut-out portion in the front surface and the back surface.

Preferably, in the developer discharge method, a width of the cut-out portion is nearly same as a thickness of the developing unit, and the developing unit is sandwiched between lateral edges of the cut-out portion.

Preferably, in the developer discharge method, a bottom surface of the main body includes: a cover which is connected to a front surface or a back surface of the main body; and a tongue which is connected to the cover, a bottom of the main body is configured to be closable by folding the tongue and the cover, inserting the tongue into the main body and covering the bottom of the main body with the cover, and the developer discharge auxiliary tool is held in a state in which a space between a front surface and a back surface is increased by extending the cover and the tongue horizontally and pressing the front surface or the back surface from inside with an end of the tongue.

Preferably, in the developer discharge method, the developer discharge auxiliary tool is held in a state in which a space between a front surface and a back surface is increased by forming a cut piece by making a cut at a part of the front surface or the back surface of the main body, folding the cut piece toward inside of the main body and pressing the back surface or the front surface with an end of the cut piece.

BRIEF DESCRIPTION OF THE DRAWINGS

The present invention will become more fully understood from the detailed description given hereinafter and the appended drawings. However, these shall not limit the present invention, and wherein.

DETAILED DESCRIPTION OF THE PREFERRED EMBODIMENTS

Figure 1:
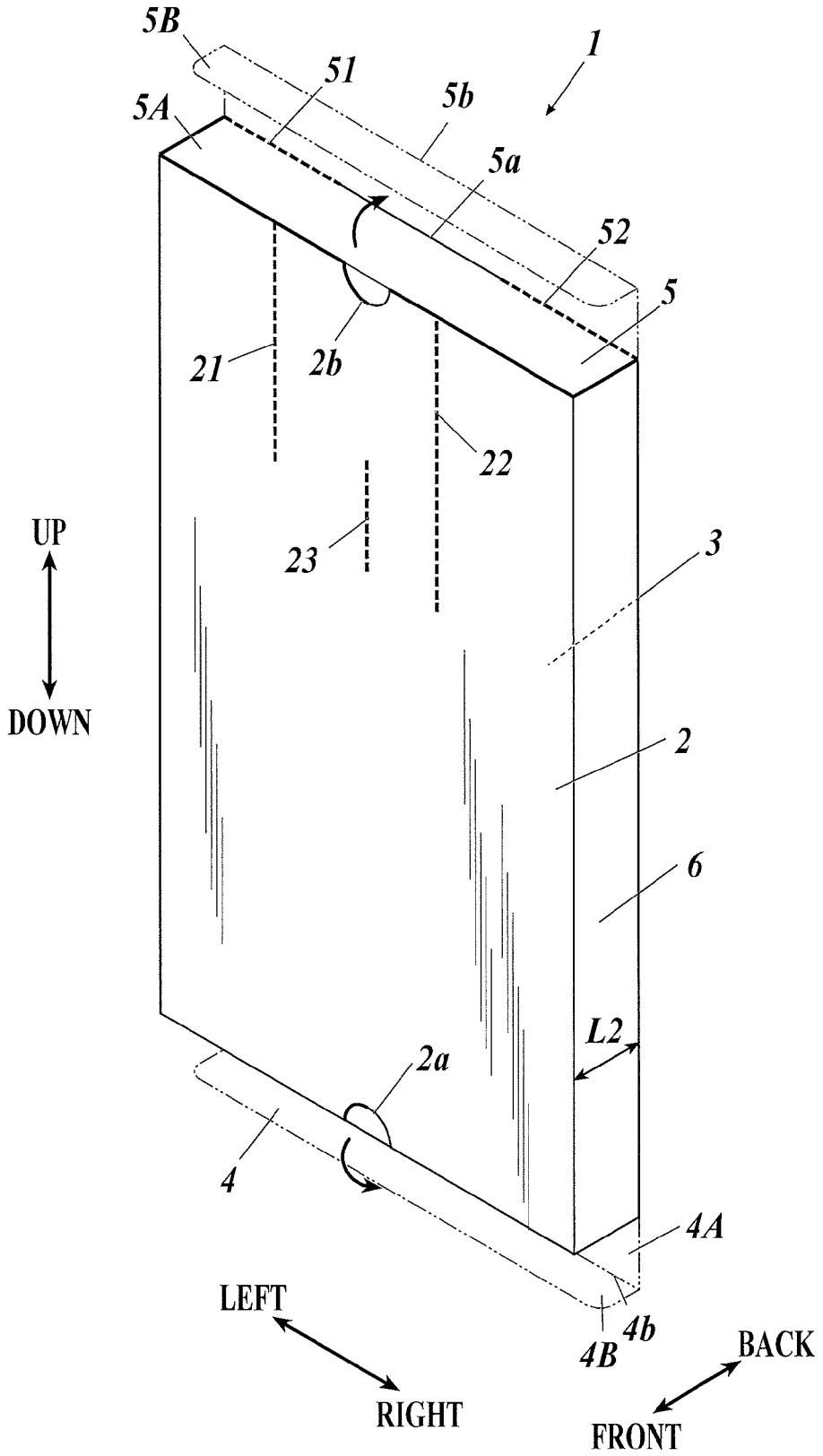
FIG. 1 is a perspective view of a developer containing box according to an embodiment.

Hereinafter, a developer containing box according to an embodiment of the present invention will be explained with reference to the drawings. However, the scope of the invention is not limited to the illustrated examples. In the description below, same reference numerals are provided to the units which have the same functions and configurations, and the explanation thereof is omitted.

The configuration of the developer containing box 1 according to the embodiment will be described with reference to FIGS. 1 to 3.

The developer containing box 1 according to the embodiment is a box which contains developer to be filled in a developing unit that is to be attached to an electrophotographic image forming apparatus, for example. The developer containing box 1 is formed of cardboard, for example. The material of the developer containing box 1 is not limited to cardboard, and various materials such as resin and metal can be applied; however, it is preferable that the developer containing box 1 is formed of a flexible material. The developer is for absorbing toners to electrostatic latent images formed on photoreceptors to form toner images, and the developer is packed in a polyethylene bag and such like and contained in the developer containing box 1, for example.

As shown in FIG. 1, the developer containing box 1 is a box body including a front surface 2, a back surface 3 facing the front surface 2, a bottom surface 4 covering the bottom surface, an upper surface 5 covering the upper surface and lateral surfaces 6 and 6 connecting the front surface 2 to the back surface 3. Here, the "box body" is in a shape having a space which can contain the developer therein, and a hexahedron such as a rectangular solid and a cube can be suggested as the box body, for example. In the embodiment, the developer containing box 1 is configured to be in a rectangular shape. In FIG. 1, chain double-dashed lines indicate the positions of the bottom surface 4 and the upper surface 5 when the bottom surface and the upper surface are open. The description below is made by referring to the shorter direction of the front surface 2 in FIG. 1 as lateral direction, the longer direction as a longitudinal direction and the depth direction as front-back direction.

The bottom surface 4 is formed of a cover 4A which is connected to the back surface 3 via a hinge 4*a* in a unified manner (see FIG. 3) and a tongue 4B which is connected to the end of the cover 4A via a hinge 4*b* in a unified manner. Flaps 61 are joined to the lower ends of the respective lateral surfaces 6 and 6 so as to be foldable (see FIG. 4). The bottom surface 4 configured in such manner can close the bottom of the developer containing box 1 by folding the pair of flaps 61 and 61 so that the ends thereof face each other, folding the tongue 4B along the hinge 4*b* to make a mountain fold, inserting the tongue 4B into the developer containing box 1 while folding the cover 4A along the hinge 4*a* so as to make a mountain fold and covering the open part in the bottom of the developer containing box 1 with the cover 4A so as to superpose the cover 4A on the pair of flaps 61 and 61.

The upper surface 5 is formed of a cover 5A which is connected to the back surface 3 via a hinge 5*a* in a unified manner and a tongue 5B which is connected to the end of the cover 5A via a hinge 5*b* in a unified manner. Flaps 62 are connected to the upper ends of the respective lateral surfaces 6 and 6 so as to be foldable (see FIG. 4). The upper surface of the developer containing box 1 can be closed with the upper surface 5 in such configuration by folding the tongue 5B along the hinge 5*b* so as to make a mountain fold after folding the pair of flaps 62 and 62 so as to make the ends thereof face each other, inserting the tongue 5B into the developer containing box 1 while folding the cover 5A along the hinge 5*a* so as to make a mountain fold and covering the open part in the upper surface of the developer containing box 1 with the cover 5A so as to superpose the cover 5A on the pair of flaps 62 and 62.

The front surface 2 is provided with cut-out portions 2*a* and 2*b* at centers in the upper and lower ends, respectively. The tongues 4B and 5B of the bottom surface 4 and the upper surface 5 can be easily reached through the cut-out portions 2*a* and 2*b*, respectively. Then, the bottom surface and the upper surface of the developer containing box 1 can be opened by rotating the bottom surface 4 and the upper surfaces 5 around the hinges 4*a* and 5*a* as supporting shafts, respectively, while having a user's finger on the tongues 4B and 5B via the cut-out portions 2*a* and 2*b*, respectively.

The front surface 2 has a breaking cut line 21 extending downward from the upper end for a predetermined distance between the left end and the center, a breaking cut line 22 which is longer than the breaking cut line 21 and extending downward from the upper end between the center and the right end and a breaking cut line 23 which is extending upward for a predetermined distance from the same position in the longitudinal direction as the end of the breaking cut line 22 in the center of the front surface 2. The breaking cut lines 21, 22 and 23 are cut lines formed of perforated lines, and the front surface 2 can be torn along the cut lines.

Figure 2:
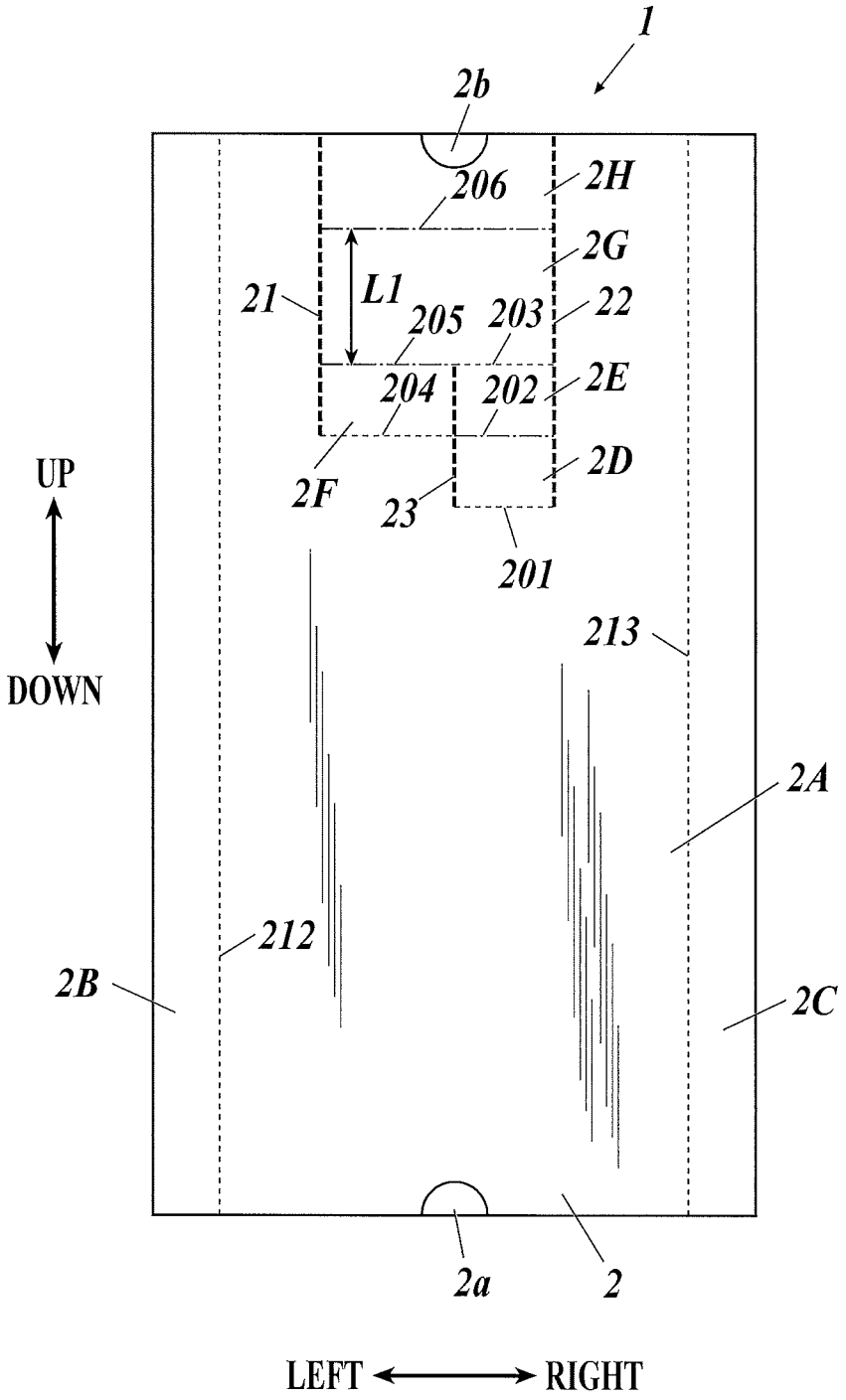
FIG. 2 is a front view of the developer containing box.

In addition, as shown in FIG. 2, the front surface 2 includes a mountain fold line 201 connecting the end of the breaking cut line 22 and one end of the breaking cut line 23, a valley fold line 202 extending to the right from the nearly central position in the breaking cut line 23 to the breaking cut line 22, and a mountain fold line 203 extending to the right from the other end of the breaking cut line 23 to the breaking cut line 22. In addition, the front surface 2 includes a mountain fold line 204 extending to the left from the nearly center of the breaking cut line 23 to the breaking cut line 21, and a valley fold line 205 extending to the left from the other end of the breaking cut line 23 to the breaking cut line 21. The front surface 2 includes a valley fold line 206 extending to the right from the breaking cut line 21 to the breaking cut line 22 at a position away from the upper end of the front surface 2 for a predetermined distance. The front surface 2 also includes mountain fold lines 212 and 213 extending from the upper end to the lower end at positions away from the left and right ends, respectively, for a predetermined distance.

The front surface 2 is configured so that a bulging surface 2A within the mountain fold lines 212 and 213 can be bulged forward by making a mountain fold along the mountain fold lines 212 and 213 to incline inclining surfaces 2B and 2C located outside the mountain fold lines 212 and 213 forward from the left and right ends of the front surface 2 as supporting shafts, respectively.

The front surface 2 includes a first folding portion 2D formed of a region surrounded by the breaking cut lines 22 and 23, the mountain fold line 201 and the valley fold line 202, a second folding portion 2E surrounded by the breaking cut lines 22 and 23, the valley fold line 202 and the mountain fold line 203, a third folding portion 2F surrounded by the breaking cut lines 21 and 23, the mountain fold line 204 and the valley line 205, an abutting portion 2G surrounded by the breaking cut lines 21 and 22, the mountain fold line 203, the valley fold lines 205 and 206, and a contacting portion 2H surrounded by the breaking cut lines 21 and 22, the valley fold line 206 and the upper end line of the front surface 2. In the embodiment, the length L1 of the abutting portion 2G is larger than the length L2 (see FIG. 1) of the lateral surface 6 so as to maintain a predetermined distance between the back surface 3 and the bulging surface 2A, that is, so as to maintain the bulging surface 2A bulging forward for a predetermined distance.

Figure 3:
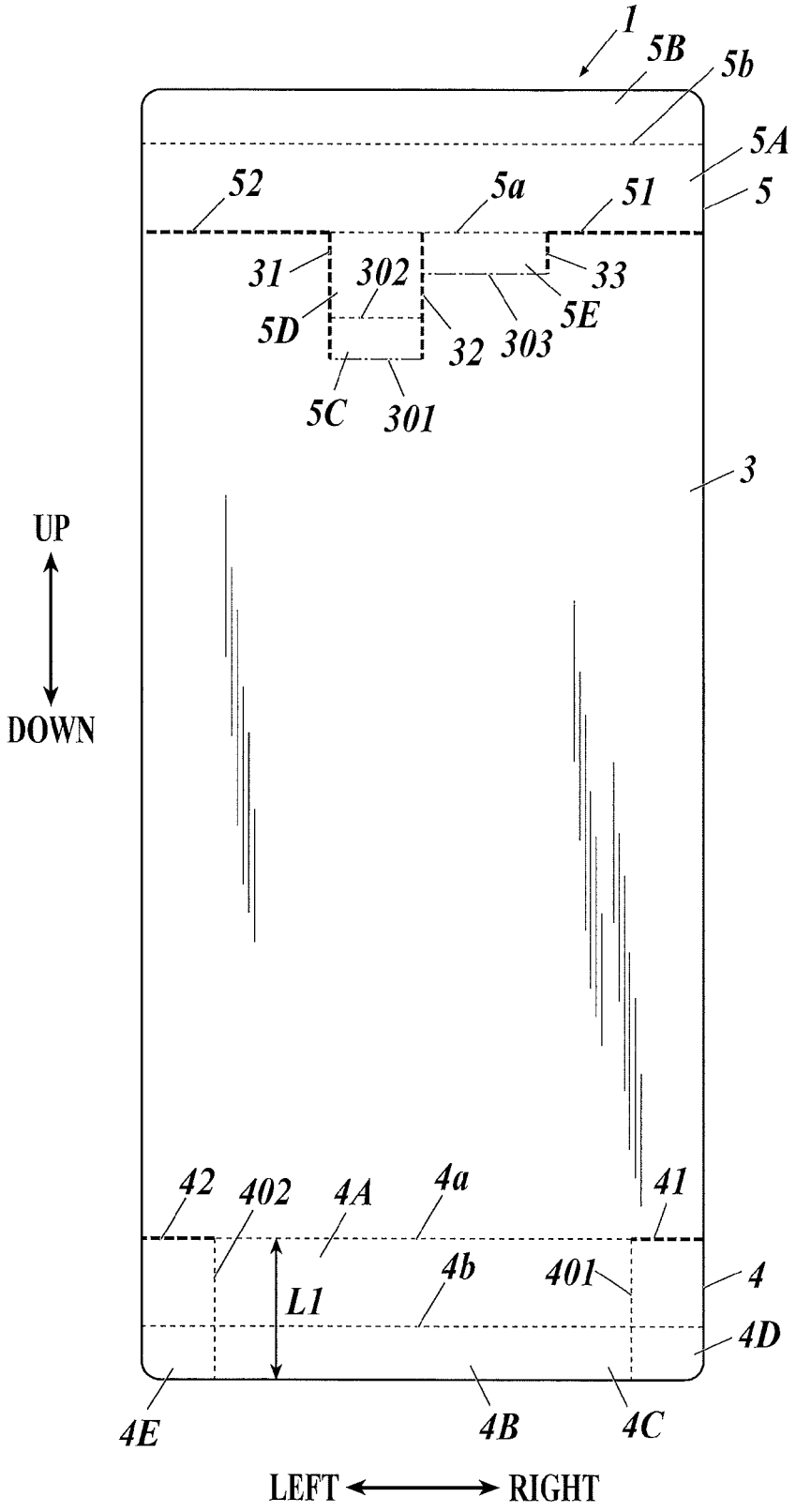
FIG. 3 is a back view of the developer containing box.

As shown in FIG. 3, the back surface 3 includes a breaking cut line 31 extending downward from the upper end position between the left end and the center for a predetermined distance, a breaking cut line 32 which is extending from the nearly central position in the upper end in parallel to the breaking cut line 31 and having the same length as the breaking cut line 31, a breaking cut line 33 which is extending downward from the upper end position between the center and the right end and shorter than the breaking cut line 31. The hinge 5*a* includes a breaking cut line 51 extending from the right end to the breaking cut line 33, and a breaking cut line 52 extending from the left end to the breaking cut line 31. The hinge 4*a* has breaking cut lines 41 and 42 extending from the right and left ends, respectively, for a predetermined distance. The breaking cut lines 41 and 42 are formed to have a same length. The breaking cut lines 31, 32, 33, 41, 42, 51 and 52 are formed of cut lines that are perforated lines, and the back surface 3 can be torn along the cut lines.

The back surface 3 further includes a valley fold line 301 connecting the end of the breaking cut line 31 and the end of the breaking cut line 32, a mountain fold line 302 which is located at a predetermined distance above the valley fold line 301 and extending from the breaking cut line 31 to the breaking cut line 32 in parallel to the valley fold line 301, and a valley fold line 303 extending to the left from the end of the breaking cut line 33 to the breaking cut line 32.

The back surface 3 includes a fourth folding portion 5C surrounded by the breaking cut lines 31 and 32, the valley fold line 301 and the mountain fold line 302, a fifth folding portion 5D surrounded by the breaking cut lines 31 and 32, the mountain fold line 302 and the hinge 5*a*, and a sixth folding portion 5E surrounded by the breaking cut lines 32 and 33, the valley fold line 303 and the hinge 5*a*.

The bottom surface 4 includes mountain fold portions 401 and 402 from the ends of the breaking cut lines 41 and 42 toward the respective ends of the tongue 4B.

The bottom surface 4 includes an abutting portion 4C surrounded by the end line of the tongue 4B, the mountain fold portions 401 and 402 and the hinge 4*a*, a flange portion 4D surrounded by the mountain fold portion 401, a side line of the cover 4A, a side line of the tongue 4B and the breaking cut line 41, and a flange portion 4E surrounded by the mountain fold portion 402, the side line of the cover 4A, the side line of the tongue 4B and the breaking cutting line 42.

A method for forming a developer discharge auxiliary tool 1A for supporting the developing unit from the developer containing box 1 which is configured as described above will be described with reference to FIGS. 1 to 4. In the embodiment, the main body of the developer discharge auxiliary tool 1A forms a main body in a box shape.

First, as described above, the bottom surface and the upper surface of the developer containing box 1 are opened by rotating the bottom surface 4 and the upper surface 5 around the hinges 4*a* and 5*a*, respectively, as supporting shafts.

Then, the front surface 2 is torn along the breaking cut lines 21, 22 and 23 to form a cut piece, a mountain fold is made at each of the mountain fold lines 201, 203 and 204, and a valley fold is made at each of the valley fold lines 202, 205 and 206. The front surface 2 is folded along the mountain fold line 203 and the valley fold line 205 so that the extending direction of the abutting portion 2G is perpendicular to the front surface 2. The front surfaces of the first folding portion 2D and the second folding portion 2E are superposed on the back surface of the front surface 2 while facing each other, and the back surface of the third folding portion 2F overlaps the back surface of the front surface 2. Since the length L1 of the abutting portion 2G is larger than the length L2 of the lateral surface 6, the bulging surface 2A is bulged forward while making mountain folds along the mountain fold lines 212 and 213 so that the abutting portion 2G vertically abuts with the back surface 3. When the abutting portion 2G abuts with the back surface of the back surface 3 in such state, the contacting portion 2H folded along the valley fold line 206 is superposed on the back surface of the back surface 3. Thus, an insertion part 2P is formed in the front surface 2 as a cut-out portion through which an after-mentioned developing unit 704K (see FIG. 6) can be inserted. The insertion part 2P has a shape that a part of the lower end thereof is further cut downward. The insertion part 2P may have any shape as long as it can support the developing unit 704K. In the embodiment, as described above, the abutting portion 2G functions as a cut piece and can hold the front surface 2 and the back surface 3 with an increased space therebetween. In the embodiment, the cut piece is formed on the front surface 2; however, the cut piece may be formed on the back surface 3.

The bottom surface 4 is first torn along the breaking cut lines 41 and 42 and a mountain fold is made along each of the mountain fold lines 401 and 402 to form the abutting portion 4C and the flanges 4D and 4E. In such state, the edge of the abutting portion 4C is made to abut with the back surface of the back surface 3 while folding the hinge 4*a* and inserting the flanges 4D and 4E into the developer containing box 1. Here, the length L1 of the abutting portion 4C is same as the length L1 of the abutting portion 2G. That is, since the length L1 of the abutting portion 4C is larger than the length L2 of the lateral surface 6, the space between the front surface 2 and the back surface 3 is increased to be the length L1 and this state can be maintained by abutting the abutting portion 4C nearly vertically to the back surface of the back surface 3 while bulging the bulging surface 2A forward. That is, in the embodiment, the front surface 2 and the back surface 3 can be held in a state in which the space therebetween is increased by extending the cover 4A and the tongue 4B horizontally and pressing the back surface 3 from inside with the end of the tongue 4B.

The back surface 3 and the upper surface 5 are first torn along the breaking cut lines 31, 32, 33, 51 and 52, respectively, a mountain fold is made along the mountain fold line 302 and a valley fold is made along each of the valley fold lines 301 and 303. Then, the back surfaces of the fourth folding portion 5C and the fifth folding portion 5D are superposed while facing each other and superposed on the front surface of the back surface 3, and the front surface of the sixth folding portion 5E overlaps the front surface of the back surface 3. At this time, the front surface of the upper surface 5 faces and overlaps the front surface of the back surface 3. Thus, an insertion part 3P as a cut-out portion through which the developing unit 704K can be inserted is formed in the back surface 3. The insertion part 3P is shaped so that a part of the lower end thereof is further cut downward. The insertion part 3P may have any shape as long as it can support the developing unit 704K.

Figure 4:
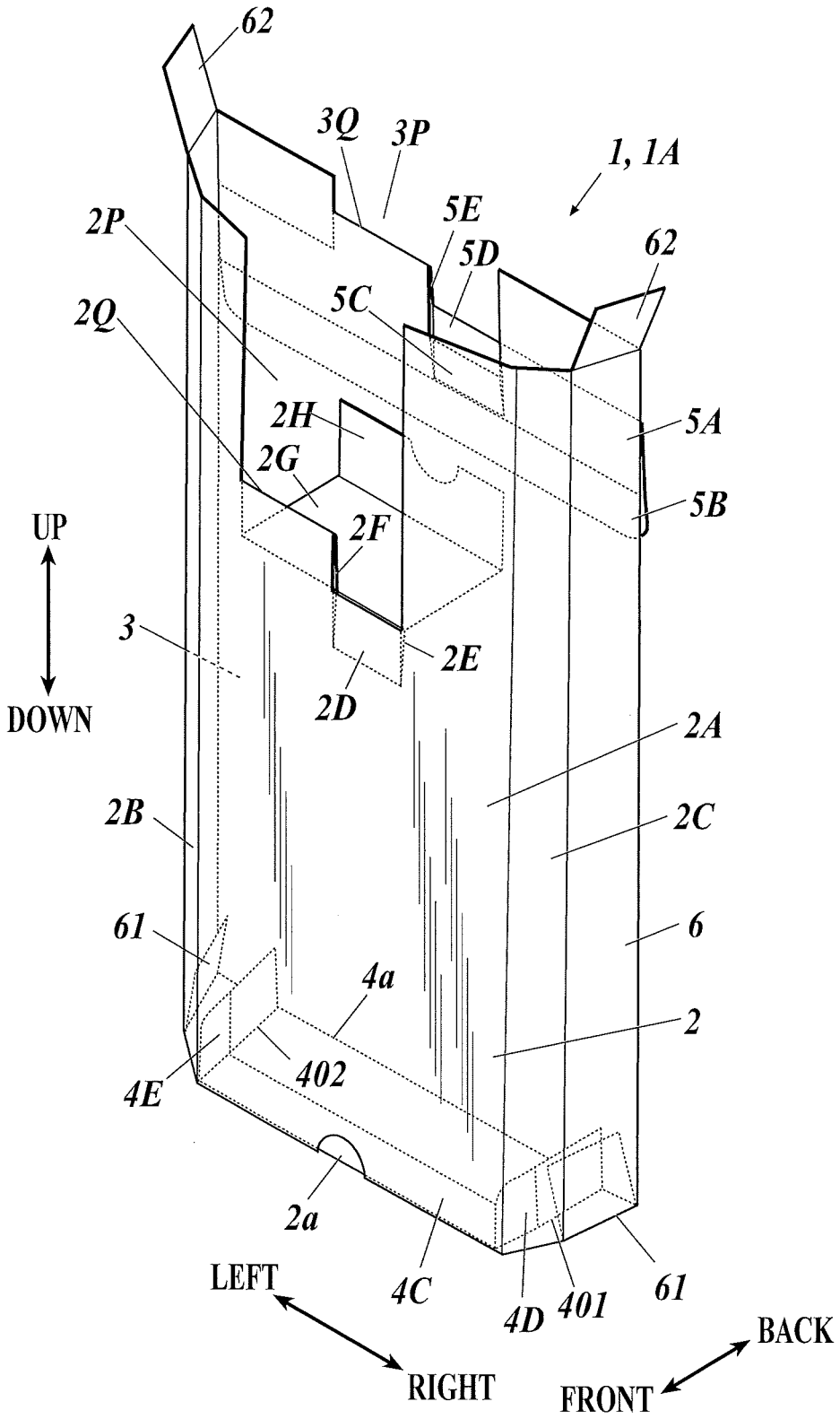
FIG. 4 is a perspective view showing a state in which the developer containing box functions as a developer discharge auxiliary tool.

In the embodiment, the developer discharge auxiliary tool 1A as shown in FIG. 4 can be formed in the above described manner.

Next, the image forming apparatus to which the developing unit used in the embodiment is attached will be described with reference to FIG. 5.

Figure 5:
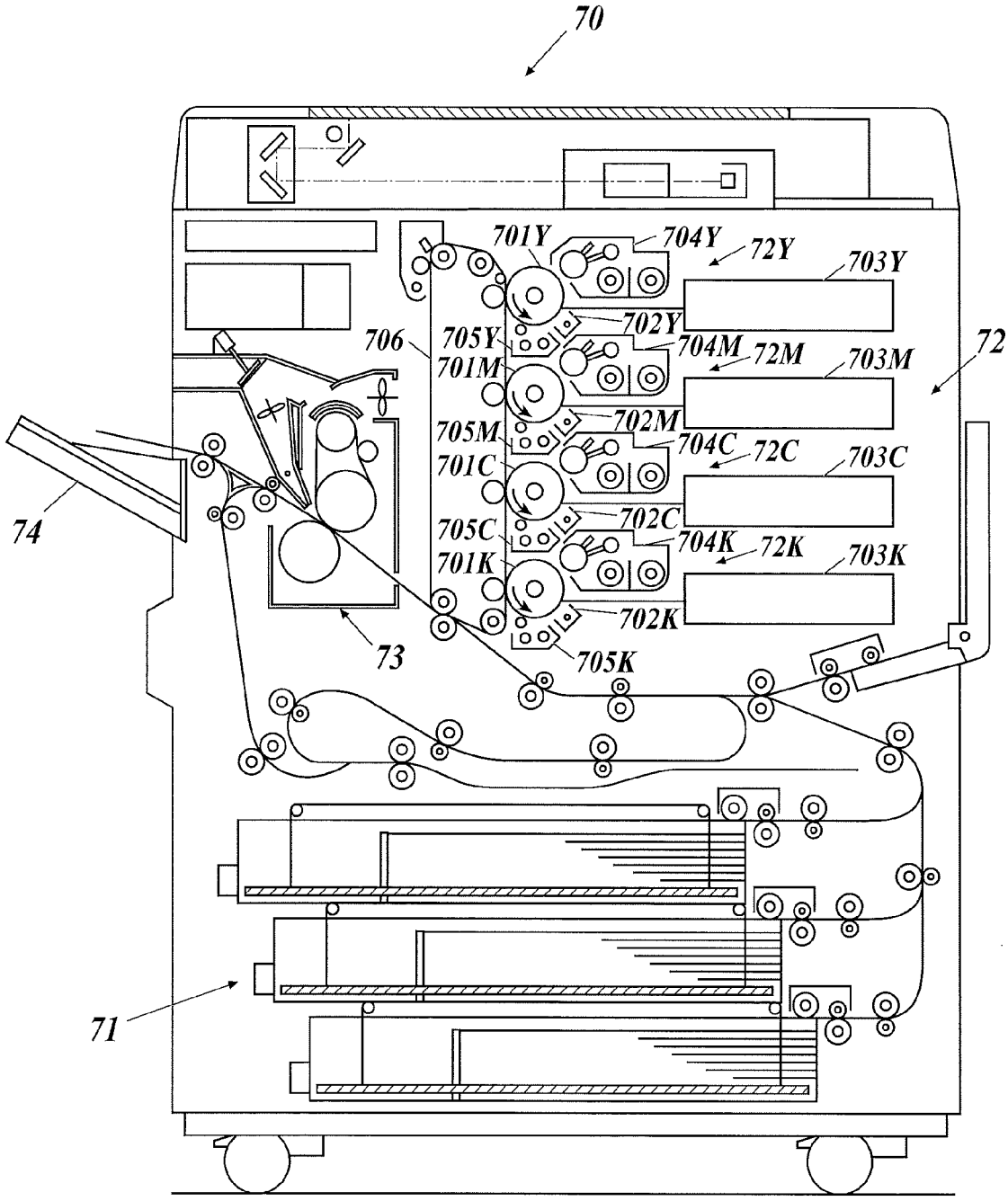
FIG. 5 is a view showing an internal configuration of an image forming apparatus.

As shown in FIG. 5, the image forming apparatus 70 is what is called a tandem-type color image forming apparatus, and performs color image formation with four image forming sections. The image forming apparatus 70 may be an image forming apparatus which performs monochrome image formation with a single image forming section.

An image on a document which is placed on a document platform is scanned and exposed by an optical system of a scanning exposure device in an image reading device and read into a line image sensor. In an image processing section (not shown in the drawings), analog processing, A/D conversion, shading correction, image compressing processing and the like are performed on an image information signal which was photoelectrically converted, and thereafter the image information signal is input to an optical writing section in the image forming section.

The image forming apparatus 70 includes a paper feeding tray 71 which contains sheets of paper, an image forming section 72 which forms an image on a sheet which was fed from the paper feeding tray 71, a fixing device 73 which performs fixation on the sheet on which an image is formed by the image forming section 72, and a paper ejection tray 74 which receives the sheet ejected outside the image forming apparatus 70 after the fixation by the fixing device 73.

The image forming section 72 includes an image forming unit 72Y which forms an image in yellow (Y), an image forming unit 72M which forms an image in magenta (M), an image forming unit 72C which forms an image in cyan (C) and an image forming unit 72K which forms an image in black (K). Since the image forming units 72Y, 72M, 72C and 72K have the same configuration, only the image forming unit 72K is described below and the explanation regarding the configurations of the other image forming units 72Y, 72M and 72C is omitted by only showing the reference numerals.

The image forming unit 72K is configured by including a photosensitive drum 701K, a charging unit 702K located therearound, an optical writing unit 703K, a developing unit 704K and a drum cleaner 705K. The developing unit 704K is set in the image forming apparatus 70 so that an after-mentioned discharge port 704*b* (see FIG. 6) is directed upward.

The image forming unit 72K writes the image information signal into the photosensitive drum 701K in the optical writing unit 703K and forms a latent image based on the image formation signal on the photosensitive drum 701K. The latent image is developed by the developing unit 704K, and a toner image which is a visible image is formed on the photosensitive drum 701K. Similarly, the image forming units 72Y, 72M and 72C forma toner image on the photosensitive drums 701Y, 701M and 701C, respectively.

The toner images formed on the photosensitive drums 701Y, 701M, 701C and 701K as described above are first transferred onto an intermediate transfer belt 706 rotated and supported by a plurality of rollers, and a color image in which the color layers of Y (Yellow), M (Magenta), C (Cyan) and K (Black) are superposed on each other is formed. The color image transferred on the intermediate transfer belt 706 is transferred onto the sheet conveyed to a secondary transfer unit which is not shown in the drawings.

Next, a rough configuration of the developing unit 704K to be attached to the image forming apparatus 70 will be described with reference to FIG. 6.

Figure 6:
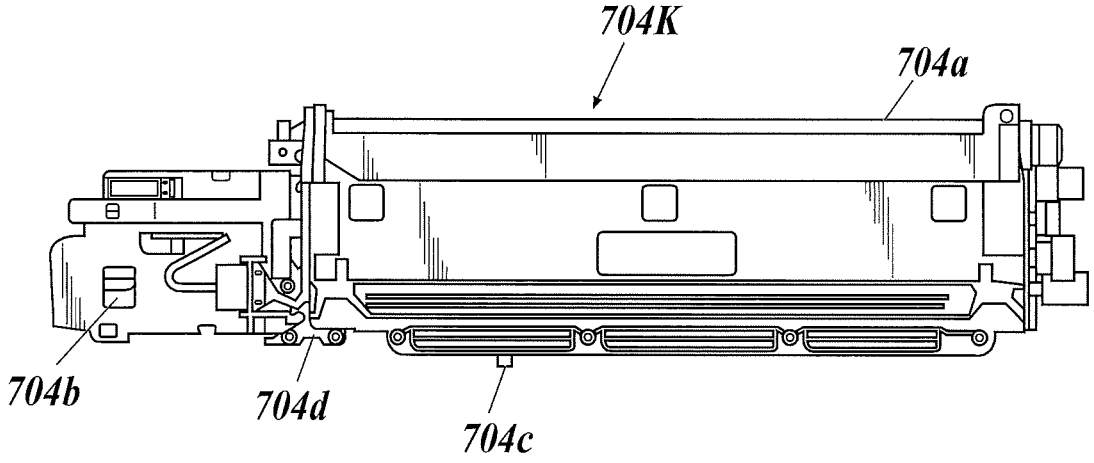
FIG. 6 is a view showing an outer appearance of a developing unit.

As shown in FIG. 6, the developing unit 704K contains developer including toners and circulates the developer therein while stirring the developer by rotating the stirring screw (not shown in the drawings) provided therein. The toners included in the developer circulated by the stirring screw are charged and held on the outer circumference of a developing roller 704*a*. The toners held on the developing roller 704*a* is conveyed outside the developing unit 704K by the rotation of the developing roller 704*a*. Since the developing roller 704*a* is located close to the photosensitive drum 701K, the toners held on the developing roller 704*a* can be attached to the photosensitive drum 701K.

A discharge port 704*b* is provided at one end of the developing unit 704K, and the developer contained therein can be discharged through the discharge port 704*b*. When the developing unit 704K is being used, the discharge port 704*b* is covered with a covering member such as a taping material so as not to spill out the developer, for example. The discharge port 704*b* may be provided at a plurality of positions.

On the lower periphery of the developing unit 704K, an L-shaped harness holder 704*c* as a protruding part and a rib 704*d* combined with a boss to thread and attach a screw are provided so as to protrude. The harness holder 704*c* and the rib 704*d* are provided at appropriate positions in addition to the position shown in FIG. 6.

Next, a method for discharging developer from the developing unit 704K configured as described above will be described with reference to FIGS. 7 and 8.

Figure 7:
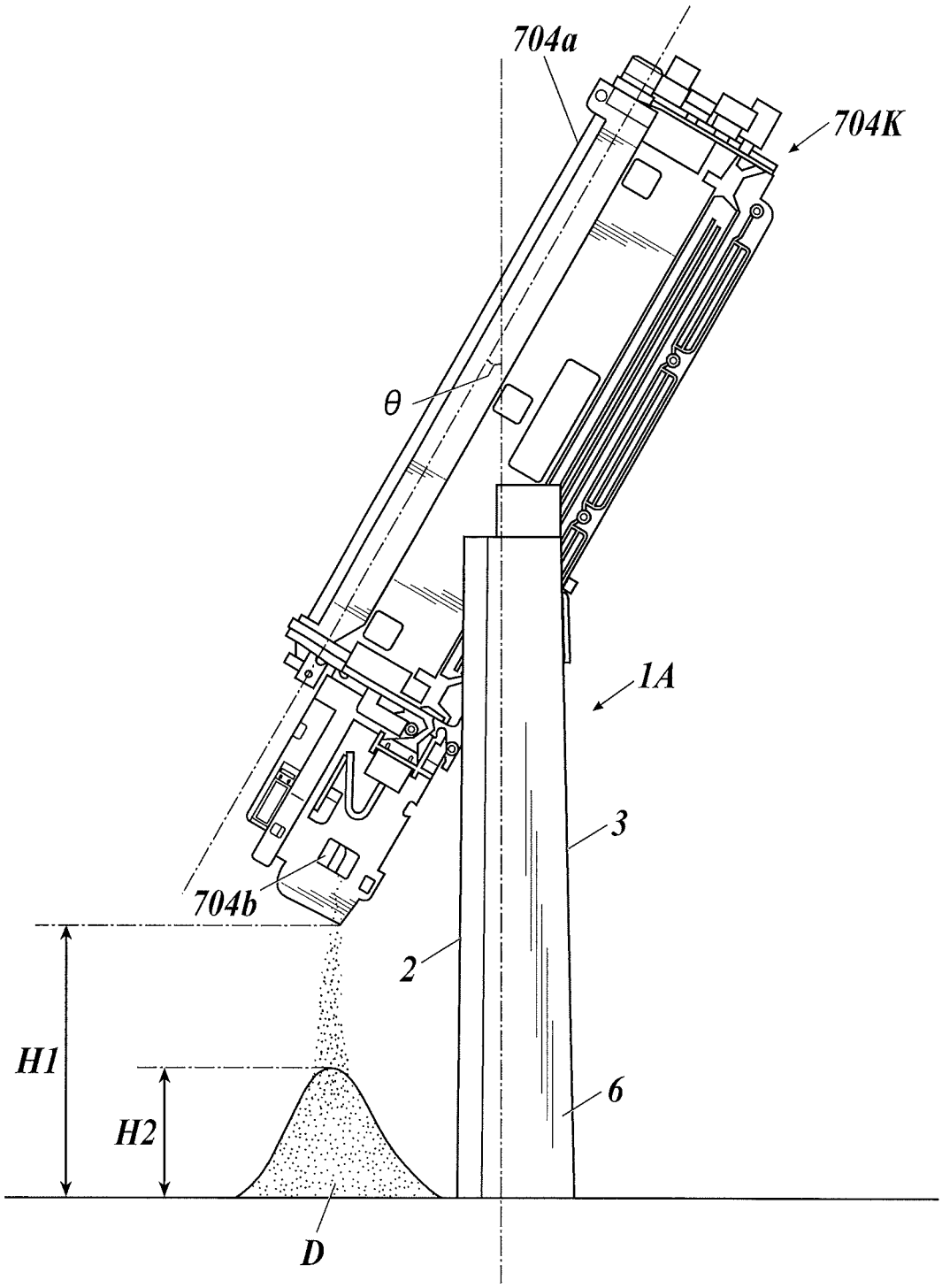
FIG. 7 is a view explaining a state in which the developer discharge auxiliary tool is used.

First, after the developer discharge auxiliary tool 1A was formed of the developer containing box 1 as described above, the developer discharge auxiliary tool 1A is vertically arranged on the work table or such like as shown in FIG. 7. Since the developer discharge auxiliary tool 1A according to the embodiment is configured so as to be held in a state in which the space between the front surface 2 and the back surface 3 is increased, the developer discharge auxiliary tool 1A can be vertically arranged with stability. FIG. 7 shows the developer discharge auxiliary tool 1A seen from the lateral surface.

Figure 8:
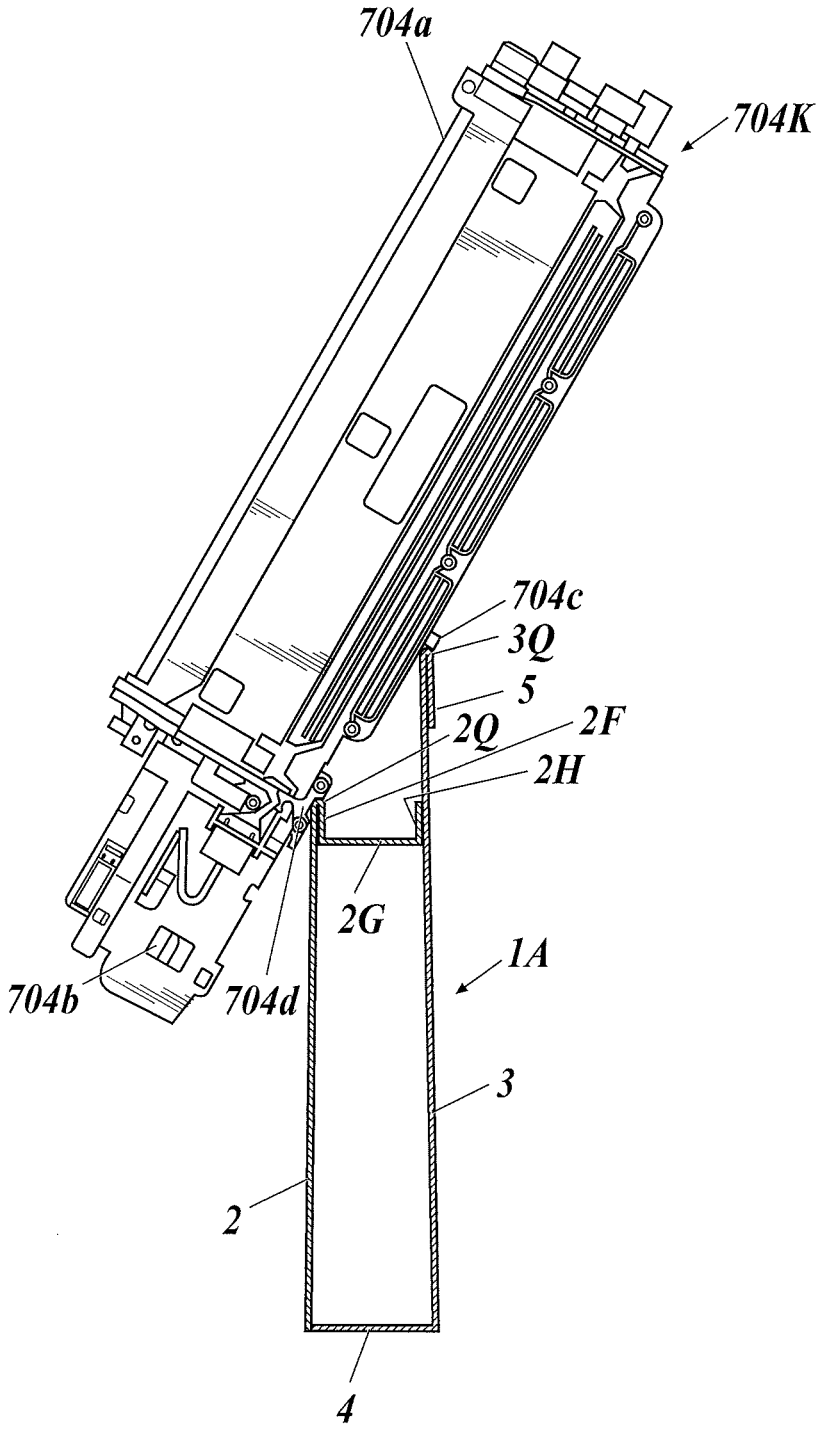
FIG. 8 is a sectional view explaining the state in which the developer discharge auxiliary tool is used.

Next, the developing unit 704K is tilted with the discharge port 704*b* down so that the discharge port 704*b* is directed laterally. The tilted developing unit 704K is inserted through the insertion parts 2P and 3P, the harness holder 704*c* is locked into the insertion part lower edge 3Q as shown in FIG. 8 and the rib 704*d* is locked into the insertion part lower edge 2Q so that the developing unit 704K is supported by the developer discharge auxiliary tool 1A. Here, each width of the insertion parts 2P and 3P is nearly the same as the thickness of the developing unit 704K to be supported, and the developing unit 704K inserted through the insertion parts 2P and 3P are sandwiched between the both lateral edges of each of the insertion parts 2P and 3P. Thus, the developing unit 704K can be supported more stably. As shown in FIG. 7, when the developing unit 704K is supported by the developer discharge auxiliary tool 1A, it is preferable that an angle θ meets $0 \leq \theta \leq 45°$, the angle θ being between the axis lines of the developer discharge auxiliary tool 1A and the developing roller 704*a* in the developing unit 704K. Thus, the developer can be discharged from the discharge port 704*b* efficiently. Though the developing unit 704K is supported by the developer discharge auxiliary tool 1A so as to direct the discharge port 704*b* laterally in the embodiment, the discharge port 704*b* may be directed at an appropriate angle between the lateral direction and the downward direction.

As described above, in the embodiment, a supporting section is formed of the insertion part lower edges 2Q and 3Q.

In such way, when the covering member covering the discharge port 704*b* is removed after the developing unit 704K is supported by the developer discharge auxiliary tool 1A, the developer contained in the developing unit 704K is discharged from the discharge port 704*b*. The developer discharged from the discharge port 704*b* is accumulated on the work table by the free fall as shown in FIG. 7. In FIG. 7, the developer accumulated on the work table is represented by the reference D. At this time, the developing unit 704K needs to be supported by the developer discharge auxiliary tool 1A maintaining a certain height so that the accumulated developer D does not adhere to the developing unit 704K. Specifically, the height of the developer D accumulated on the work table when all the developer contained in the developing unit 704K is discharged is H2. Therefore, the developer discharge auxiliary tool 1A holds the developing unit 704K so that the height from the work table to the lower end of the developing unit 704K is H1 which is larger than the height H2 of the accumulated developer D.

As described above, in the embodiment, the insertion part lower edges 2Q and 3Q support the developing unit 704K, which is provided with the discharge port 704*b* to discharge the contained developer, at a predetermined height with the discharge port 704*b* down so that the discharge port 704*b* is directed laterally or downward. As a result, when the developer is discharged from the developing unit, the developing unit does not need to be supported by both hands, which reduces the burden of discharging the developer in the developing unit.

In the embodiment, since insertion parts 2P and 3P through which the developing unit 704K can be inserted are formed at parts of the developer discharge auxiliary tool 1A and the developing unit 704K is supported by the insertion part lower edges 2Q and 3Q in the insertion parts 2P and 3P, and thus the developing unit can be supported more stably.

In the embodiment, the developer discharge auxiliary tool 1A supports the developing unit 704K by locking the harness holder 704*c* and the rib 704*d* into the insertion part lower edges 2Q and 3Q in the insertion parts 2P and 3P. As a result, the developing unit can be prevented from detaching from the insertion parts and falling down, and thus can be supported more stably.

In the embodiment, the insertion parts 2P and 3P are formed by cutting the front surface 2 and the back surface 3 in the developer discharge auxiliary tool 1A. The developing unit 704K is supported by locking the harness holder 704*c* and the rib 704*d* provided on the developing unit 704K into the insertion part lower edge 3Q of the insertion part 3P in the back surface 3 and the insertion part lower edge 2Q of the insertion part 2P in the front surface 2, respectively. As a result, the developing unit can be supported more stably.

In the embodiment, each of the widths of the insertion parts 2P and 3P is nearly the same as the thickness of the developing unit 704K, and the developing unit 704K is sandwiched by the both lateral ends of each of the insertion parts 2P and 3P. As a result, the developing unit can be supported more stably.

In the embodiment, the bottom surface 4 includes a cover 4A connected to the front surface 2 and the back surface 3, and the tongue 4B connected to the cover 4A, and is configured so that the bottom of the developer discharge auxiliary tool 1A main body can be closed by folding the tongue 4B and the cover 4A, inserting the tongue 4B into the main body of the developer discharge auxiliary tool 1A and covering the bottom of the developer discharge auxiliary tool 1A with the cover 4A. The developer discharge auxiliary tool 1A is configured to be holdable in a state in which the space between the front surface 2 and the back surface 3 is increased by extending the cover 4A and the tongue 4B horizontally and pressing the front surface 2 and the back surface 3 from inside with the end of the tongue 4B. Thus, the developer discharge auxiliary tool can be vertically arranged with stability to support the developing unit.

In the embodiment, the developer discharge auxiliary tool 1A is configured to be holdable in a state in which the front surface 2 and the back surface 3 have the increased space therebetween by forming a cut piece by making a cut at a part of the front surface 2 or the back surface 3, folding the cut piece inward and pressing the back surface 3 or the front surface 2 with the end of the cut piece. Thus, the developer discharge auxiliary tool can be vertically provided stably to support the developing unit.

In the embodiment, since the developer discharge auxiliary tool 1A is formed of a flexible material, the developer discharge auxiliary tool can be formed easily.

In the embodiment, since the developer discharge auxiliary tool 1A is formed of the developer containing box 1 which contains the developer, the containing box containing the developer can be reused to form a jig for holding the developing unit, and thus, cost reduction can be achieved.

The embodiment is described as an example of the developer containing box according to the present invention, and the present invention is not limited to this. Changes can also be appropriately made with respect to the detailed configurations and detailed operations of the functional sections forming the developer containing box.

Though the embodiment is described by taking an example in which the developer is discharged from the developing unit 704K which contains the developer including black toners, it goes without saying that the present invention can also be applied to the developing units 704Y, 704M and 704C which contain the developers including yellow, magenta and cyan toners, respectively.

Though the embodiment was described by taking an example in which the developer discharge auxiliary tool 1A is formed of the developer containing box 1 which contains the developer, the developer discharge auxiliary tool may be a dedicated jig, for example.

Though the insertion parts 2P and 3P to insert the developing unit 704K are formed by tearing the parts of the developer containing box 1 along the breaking cut lines and folding the torn parts in the embodiment, the torn parts may be cut off to form the insertion parts.

Though the embodiment is described by taking, as an example, the harness holder 704*c* and the rib 704*d* as protruding parts, the protruding part may be anything as long as it protrudes from the periphery of the developing unit 704K and can be locked into the edges of the insertion parts 2P and 3P.

Though the insertion parts 2P and 3P are provided on the front surface 2 and the back surface 3, respectively, in the embodiment, the insertion part may be provided to only one of the front surface 2 and the back surface 3.

Though the developing unit 704K is supported by locking the protruding parts to the edges of the insertion parts 2P and 3P in the embodiment, the developing unit 704K may be supported by providing an antislip section formed of a material with a high friction coefficient such as rubber on the surface of the developing unit 704K and supporting the developing unit 704K by locking the antislip section to the edges of the insertion parts 2P and 3P, for example.

Though the developing unit 704K is supported by locking the two protruding parts that are the harness holder 704*c* and the rib 704*d* into the edges of the insertion parts 2P and 3P, respectively, in the embodiment, the developing unit 704K may be supported by locking a single protruding part into the edge of the insertion part 2P or the insertion part 3P. Three protruding parts or more may be locked into the edges of the insertion parts 2P and 3P.

Though the developer discharge auxiliary tool 1A is formed in a box shape in the embodiment, the developer discharge auxiliary tool 1A is not limited to the box shape, and may have other shapes as long as it can support the developing unit.

The entire disclosure of Japanese Patent Application No. 2013-111432 filed on May 28, 2013 including description, claims, drawings, and abstract are incorporated herein by reference in its entirety.

What is claimed is:

1. A developer discharge method for discharging developer from a developing unit used for an image forming apparatus, which contains the developer, forms a toner image on an image holding body and has a discharge port to discharge the developer contained therein on at least one end thereof, the developer discharge method comprising:

discharging the developer through the discharge port by supporting the developing unit, which contains the developer, at a predetermined height with a supporting section formed in a box-shaped main body that is included in a developer discharge auxiliary tool, the supporting section supporting the developing unit with the discharge port down in a state in which the discharge port is located on a lateral or lower side of the developing unit;

wherein the developer discharge auxiliary tool is formed so that a cut-out portion through which the developing unit is insertable is formed at a part of a containing box which contains the developer, and an edge of the cut-out portion forms the supporting section;

wherein the supporting section supports the developing unit by locking a protruding part provided on the developing unit into the edge of the cut-out portion;

wherein the cut-out portion is formed by cutting a front surface and a back surface of the containing box, and the developing unit is supported by locking two protruding parts provided on the developing unit into respective edges of the cut-out portion in the front surface and the back surface.

2. A developer discharge method for discharging developer from a developing unit used for an image forming apparatus, which contains the developer, forms a toner image on an image holding body and has a discharge port to discharge the developer contained therein on at least one end thereof, the developer discharge method comprising:

discharging the developer through the discharge port by supporting the developing unit, which contains the developer, at a predetermined height with a supporting section formed in a box-shaped main body that is included in a developer discharge auxiliary tool, the supporting section supporting the developing unit with the discharge port down in a state in which the discharge port is located on a lateral or lower side of the developing unit;

wherein the developer discharge auxiliary tool is formed so that a cut-out portion through which the developing unit is insertable is formed at a part of a containing box which contains the developer, and an edge of the cut-out portion forms the supporting section;

wherein a bottom surface of the main body comprises:

a cover which is connected to a front surface or a back surface of the main body; and a tongue which is connected to the cover, a bottom of the main body is configured to be closable by folding the tongue and the cover, inserting the tongue into the main body and covering the bottom of the main body with the cover, and the developer discharge auxiliary tool is held in a state in which a space between a front surface and a back surface is increased by extending the cover and the tongue horizontally and pressing the front surface or the back surface from inside with an end of the tongue.

3. A developer discharge method for discharging developer from a developing unit used for an image forming apparatus, which contains the developer, forms a toner image on an image holding body and has a discharge port to discharge the developer contained therein on at least one end thereof, the developer discharge method comprising:

discharging the developer through the discharge port by supporting the developing unit, which contains the developer, at a predetermined height with a supporting section formed in a box-shaped main body that is included in a developer discharge auxiliary tool, the supporting section supporting the developing unit with the discharge port down in a state in which the discharge port is located on a lateral or lower side of the developing unit;

wherein the developer discharge auxiliary tool is formed so that a cut-out portion through which the developing unit is insertable is formed at a part of a containing box which contains the developer, and an edge of the cut-out portion forms the supporting section;

wherein the developer discharge auxiliary tool is held in a state in which a space between a front surface and a back surface is increased by forming a cut piece by making a cut at a part of the front surface or the back surface of the main body, folding the cut piece toward inside of the main body and pressing the back surface or the front surface with an end of the cut piece.

* * * * *